United States Patent [19]

Fisher

[11] Patent Number: 4,895,255

[45] Date of Patent: Jan. 23, 1990

[54] SHRINK WRAPPED SHIPPING BUNDLE OF BLISTER PACKAGES FOR WINDSHIELD WIPERS

[75] Inventor: Brian A. Fisher, Burlington, Canada

[73] Assignee: Tridon Limited, Oakville, Canada

[21] Appl. No.: 234,776

[22] Filed: Aug. 22, 1988

[51] Int. Cl.[4] ..... B65D 71/08

[52] U.S. Cl. ..... 206/497; 206/45.14; 206/45.33; 206/461; 206/499; 206/586

[58] Field of Search ..... 206/45.14, 45.19, 45.31, 206/45.33, 461, 485, 497, 499, 504, 526, 432, 585, 586, 588, 564, 563, 806

[56] References Cited

U.S. PATENT DOCUMENTS

| | | | |
|---|---|---|---|
| 3,057,472 | 10/1962 | Douty | 206/497 X |
| 3,127,273 | 3/1964 | Monahan | 206/45.34 |
| 3,187,889 | 6/1965 | Sinclair | 206/499 |
| 3,306,689 | 2/1967 | Isaacson et al. | 206/45.33 |
| 3,454,157 | 7/1969 | Kulig | 206/499 X |
| 3,642,124 | 2/1972 | Brown et al. | 206/45.33 |
| 3,650,395 | 3/1972 | Hobbs | 206/45.33 |
| 3,721,339 | 3/1973 | Seyer | 206/499 X |
| 3,856,137 | 12/1974 | Brindley | 206/564 |
| 3,872,966 | 3/1975 | Gordon et al. | 206/45.31 |
| 4,319,680 | 3/1982 | Hiemstra | 206/45.14 |

FOREIGN PATENT DOCUMENTS

| | | | |
|---|---|---|---|
| 1456468 | 11/1976 | United Kingdom | 206/482 |

*Primary Examiner*—Bryon P. Gehman
*Attorney, Agent, or Firm*—Rogers & Scott

[57] ABSTRACT

An end cap for insertion over a plurality of packages each having at least one end which is susceptible to bending when the packages are shrink wrapped into a bundle. The end cap comprises an end panel for location over said ends and four dependent sides defining an opening to receive the packages, said sides extending partly along the length of the packages to locate the packages in a bundle so that during shrink wrapping of the bundle any forces exerted by a shrink wrapping film will be distributed over the end cap and the pressure on the ends received in the end cap will be minimized.

1 Claim, 2 Drawing Sheets

SHRINK WRAPPED SHIPPING BUNDLE OF BLISTER PACKAGES FOR WINDSHIELD WIPERS

This invention relates to the packaging of blister packages which are shrink wrapped for shipping and distribution.

While the invention will be described particularly with reference to packages for windshield wipers, it is understood that the invention has application to the packaging of articles other than windshield wipers.

Commonly, windshield wipers are packaged individually and shipped to a retail outlet in boxes having a capacity to hold fifty wiper packages. The wiper packages are conveniently grouped in bundles of five for stocking up depleting display units and each package has a perforated substantially planar header adapted to receive a hanger for suspending the package at the display wall.

In order that the contents of each bundle may be easily ascertained, it is proposed to shrink wrap the bundles in clear synthetic plastic having a thin gauge which is easily torn so that the packages may be separated with a minimum of effort.

Unfortunately, when groups of packages having planar headers perforated for suspending the packages are shrink wrapped, the headers are urged inwardly towards the centerline of the bundle and become bent, thereby adversely affecting their appearance.

In a boxed package, damage to the header may be minimized by providing the package with a fold line at the junction between the header and an adjoining panel and by folding the header over the adjoining panel and securing the folded header on the panel with adhesive before shrink wrapping. The adhesive is selected so that the header may be easily released from the panel and the package is suspended for display with the creases from folding the header looking relatively neat and tidy.

In a blister package, it is desirable and convenient to reinforce the header portion with ribs or buttress extensions of a cavity formed in the blister to contain the packaged article. This helps to preserve the point-of-sale appearance of the blister package which, by its nature, is more susceptible to damage during shipping than a boxed package. Such reinforcement, however, is usually insufficient to withstand the forces produced during shrink wrapping and additional measures must be taken to maintain the package in mint condition. It will also be noted that the side walls of the cavity in a blister package are not very often at right angles to the upper and lower surfaces of the package so that even without reinforcement of the header, it is impractical to fold the header over the adjoining side or blister wall.

An object of this invention is to provide a means whereby packages having headers for suspending the packages may be shrink wrapped with minimal damage to the headers.

In accordance with the invention, there is provided an end cap for insertion over the ends of a plurality of packages being shrink wrapped in bundles for shipping and storage, the end cap being adapted to withstand any forces exerted on the ends of the packages during such shrink wrapping so that when the packages are displayed, they will have a fresh appearance.

A preferred embodiment of the invention is described below with reference to the accompanying drawings in which.

Figure 1:
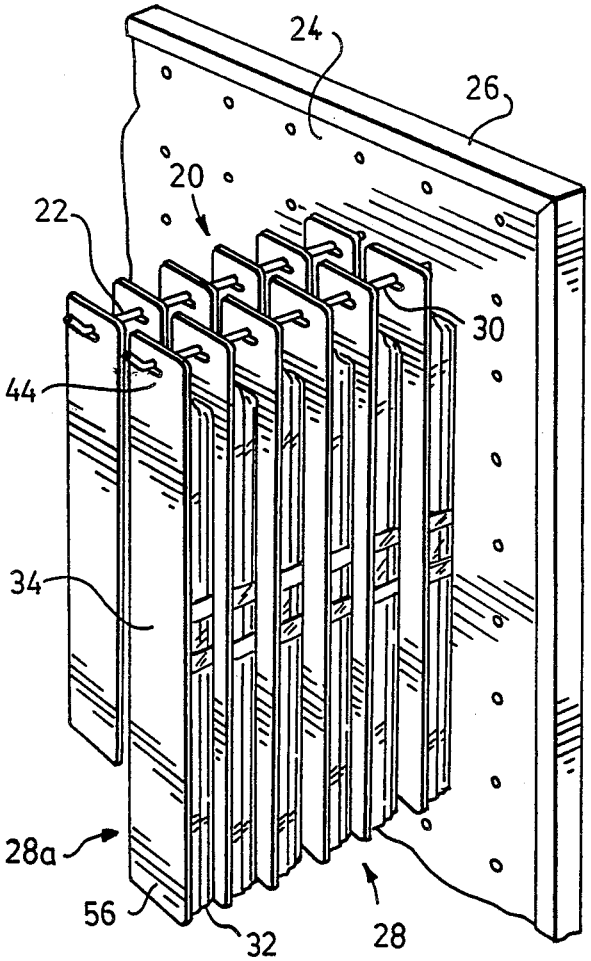
FIG. 1 is a perspective view illustrating a plurality of blister packages suspended for display from hangers inserted through headers which form part of the packages.

Reference is made firstly to FIG. 1 which illustrates a plurality of elongate blister packages 20 suspended from a hanger 22 supported from pegboard 24 of a display wall 26. Different packages 28 are suspended from a second hanger 30 attached to the pegboard 24. In the example shown, the packages 20 contain a first size of wiper blade and the packages 28, a longer wiper blade.

These packages are exemplary and will of course vary in shape and size according to the product being contained.

Making reference particularly t package **28*a* which is furthest from the display wall 26, it will be seen that the package 28*a* includes a blister 32 which protrudes from an associated planar substrate 34 laminated to the blister to define a sealed cavity. In this case, the median height of the blister cavity is selected to accomodate a wiper and it is greater in magnitude than the thickness of the substrate, in particular at a header 44 which is integrally formed with the substrate and is perforated to receive the hanger 30**.

It will be apparent that the header 44 is susceptible to bending or folding, in particular, on application of a transverse force of the kind produced during shrink wrapping. To minimize such bending, and delamination of the package, an end cap according to the invention is inserted over the ends of the package such that any forces exerted by a shrink wrapping film will be distributed over the end cap and the pressure on the header will be minimized.

Figure 2:
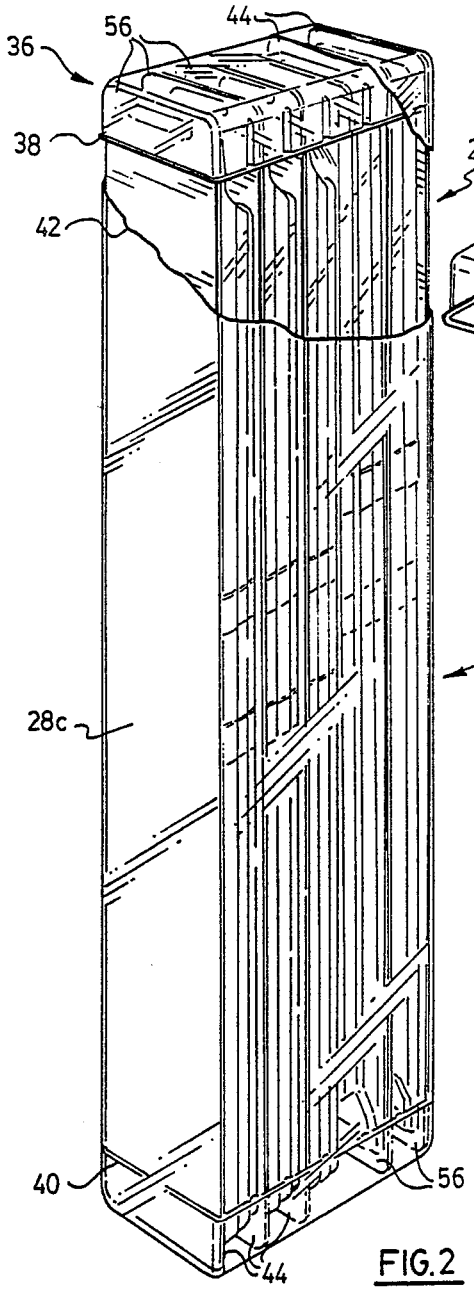
FIG. 2 is a perspective view drawn to a larger scale than FIG. 1 and illustrating a shrink wrapped bundle of five blister packages in which the shrink wrapping film is partly cut away to expose an upper end cap according to the invention.

Reference is next made to FIG. 2 which illustrates a bundle 36 of five packages 28 which have been shrinked wrapped for shipping and distribution to retail outlets in a clear, thin film 42 of synthetic plastic material. The packages 28 are stacked and arranged adjacent one another so that their ends are flush and at each extremity of the bundle 36, the ends, including the headers 44, are received in respective upper and lower end caps 38, 40.

Figure 3:
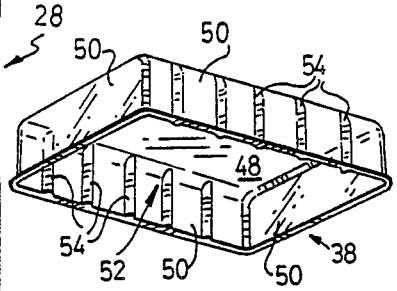
FIG. 3 is a perspective view looking upward and drawn beside FIG. 2 showing the upper end cap of FIG. 2.

The upper end cap 38 is more clearly seen in FIG. 3 and includes a rectangular end panel 48 for location over the ends of the packages and four dependent sides 50 which define an opening 52 to receive the packages. Preferably, the end cap 38 is made of self-supporting transparent synthetic plastic material to permit easy visual identification of the contents of the bundle 36. For additional rigidity, the longer opposing sides 50 of the end cap are deformed to have transversely extending ribs 64 extending between the opening 52 and the end panel 48.

Before placing the end caps 38, 40 over the ends of the packages, outermost packages **28*b*, 28*c* are oriented with their respective blisters directed inwardly towards each other such that their respective substrates define opposite external sides of the bundle 36** which are planar and more suited to sustaining the pressures exerted during shrink wrapping. Furthermore, it will be noted that the blister cavity will usually extend to the foot of the package remote from the header and the packages are oriented such that the headers of some of the packages are opposite to the feet of adjacent packages, thereby further improving the rigidity of the bundle.

Conveniently, the end caps 38, 40 will operate to locate the packages in a bundle and so will maintain the selected orientation of the packages prior to shrink wrapping. Shrink wrapping of the bundles is carried out in conventional fashion and the bundles, in turn, are packaged in labelled boxes and shipped for distribution to retail outlets.

At a retail outlet, the boxes are opened and whenever display stocks are low, a bundle is retrieved and opened. It will be appreciated that the number of packages in a bundle may be varied according to the size of the packages and the capacity of the hangers. It has been found with windshield wipers that a bundle of five packages is easily held in one hand and is thus most convenient.

I claim:

1. A shipping bundle of windshield wipers comprising:

a plurality of individual elongate blister packages having two ends, each of the packages having a substantially rectangular planar substrate and a blister attached to the substrate to define a sealed cavity containing a windshield wiper, the substrate including a header at one end defining an opening for suspending the package from a display, the individual packages being arranged adjacent one another in a rectangular grouping so that the needs of the packages are flush and define first and second ends of the grouping, the blisters of the outermost packages being directed inwardly towards one another such that their respective substrates define opposite external sides of the grouping;

a pair of self-supporting rectangular end caps of synthetic plastics material each having an end panel and four sides extending from the end panel, the end caps being located on respective ends of the grouping such that the plurality of packages is received therein and the orientation of the packages in the grouping is maintained; and a transparent shrink wrap extending about the caps and the rectangular grouping and supported by the substrates of said outermost packages so as to contain the rectangular grouping, the loading created by the shrink wrap being distributed by the end caps over the ends of the rectangular grouping so as to minimize damage to the individual packages and preserve the appearance of the individual packages for subsequent display, the packages being visible through the shrink wrap to permit easy identification of the contents of the bundle.

* * * * *